United States Patent [19]

Harandi et al.

[11] Patent Number: 4,981,574

[45] Date of Patent: Jan. 1, 1991

[54] DEWAXING PROCESS

[75] Inventors: Mohsen N. Harandi, Lawrenceville; Hartley Owen, Belle Mead, both of N.J.

[73] Assignee: Mobil Oil Corporation, Fairfax, Va.

[21] Appl. No.: 322,880

[22] Filed: Mar. 14, 1989

[51] Int. Cl.[5] ..... C10G 11/02

[52] U.S. Cl. ..... 208/60; 208/70

[58] Field of Search ..... 208/58, 60, 70, 77, 208/59

[56] References Cited

U.S. PATENT DOCUMENTS

| | | | |
|---|---|---|---|
| Re. 28,398 | 4/1975 | Chen et al. | 208/111 |
| 3,668,113 | 6/1972 | Burbidge et al. | 208/97 |
| 3,755,138 | 8/1973 | Chen et al. | 208/33 |
| 3,756,942 | 9/1973 | Cattanach | 208/138 |
| 3,758,628 | 9/1973 | Strickland et al. | 208/60 X |
| 3,759,821 | 9/1973 | Brennan et al. | 208/93 |
| 3,907,663 | 9/1975 | Owen | 208/70 |
| 3,956,102 | 5/1976 | Chen et al. | 208/93 |
| 4,054,508 | 10/1977 | Milstein et al. | 208/89 |
| 4,100,056 | 7/1978 | Reynolds | 208/57 |
| 4,267,071 | 5/1981 | Jaffee | 252/439 |
| 4,390,413 | 6/1983 | O'Rear et al. | 208/70 X |
| 4,400,265 | 8/1983 | Shen | 208/97 |
| 4,478,709 | 10/1984 | Yan | 208/70 X |
| 4,483,760 | 11/1984 | Tabak et al. | 208/60 |
| 4,600,503 | 7/1986 | Angevine et al. | 208/251 |

*Primary Examiner*—Glenn Caldarola

*Attorney, Agent, or Firm*—Alexander J. McKillop; Charles J. Speciale; Robert B. Furr, Jr.

[57] ABSTRACT

A process is disclosed for dewaxing a waxy hydrocarbon feedstock and for upgrading the olefinic interstage by-product to a high-octane gasoline blending stream. Waxy hydrocarbon feedstock is catalytically dewaxed until the catalyst is deactivated. Hydrogen-rich gas or, optionally, oxygen-containing gas, is then circulated to at least partially reactivate the catalyst. The interstage by-product, stored during the dewaxing run, is then upgraded in the reaction zone to a high-octane gasoline blending component.

24 Claims, 2 Drawing Sheets

DEWAXING PROCESS

BACKGROUND OF THE INVENTION

This invention relates to the upgrading of the olefinic by-product stream produced in low-severity catalytic hydrocarbon conversion processes. In particular, this invention relates to upgrading the olefinic by-product stream produced by the catalytic dewaxing of waxy hydrocarbon feedstocks in the presence of a medium-pore zeolite catalyst.

Catalytic dewaxing of hydrocarbon oils to reduce the temperature at which precipitation of waxy hydrocarbons occurs is a known process and is described, for example, in the *Oil and Gas Journal*, Jan. 6, 1975, pages 69–73. A number of patents have also described catalytic dewaxing processes. U.S. Pat. No. Reissue 28,398 describes a process for catalytic dewaxing with a catalyst comprising a medium-pore zeolite and a hydrogenation/dehydrogenation component. U.S. Pat. No. 3,956,102 teaches a process for hydrodewaxing a gas oil with a medium-pore zeolite catalyst. U.S. Pat. No. 4,100,056 discloses a Mordenite catalyst containing a Group VI or a Group VIII metal which may be used to dewax a distillate derived from a waxy crude. U.S. Pat. No. 3,755,138 describes a process for mild solvent dewaxing to remove high quality wax from a lube stock, which is then catalytically dewaxed to specification pour point. Such developments in catalytic dewaxing have led to the MLDW (Mobil Lube Dewaxing) and MDDW (Mobil Distillate Dewaxing) processes. The entire contents of the above-listed publications and patents are incorporated by reference as if set forth at length herein.

Dewaxing is typically a two-step process comprising catalytic dewaxing followed by hydrotreating. Certain feedstocks, particularly distillate feedstocks, however, may meet product specifications without hydrotreating. In lubricant manufacturing, hydrotreating improves color and reduces sulfur content of the finished product. Hydrotreating also saturates the olefinic by-products from the dewaxing reaction and is typically used for this purpose as well as to reduce sulfur and to increase cetane number in distillate products. For example, U.S. Pat. No. 3,668,113 describes a catalytic dewaxing process employing a Mordenite dewaxing catalyst which is followed by a catalytic hydrodesulfurization step over an alumina-based catalyst. U.S. Pat. No. 4,400,265 describes a catalytic dewaxing/hydrodewaxing process using a zeolite catalyst having the structure of ZSM-5 wherein gas oil is catalytically dewaxed followed by hydrodesulfurization in a cascade system. Hydrotreating processes are widely used in the petroleum refining industry and are exemplified by the processes described in U.S. Pat. Nos. 4,054,508 to Milstein et al.; 4,267,071 to Jaffe; and 4,600,503 to Angevine et al., each of which is incorporated by reference as if set forth at length herein.

Commonly-assigned application Ser. No. 125,435, filed Nov. 11, 1987, teaches a hydrodewaxing process with interstage recovery of olefinic gasoline and is incorporated by reference as if set forth at length herein. The hydrodewaxing process described comprises a first catalytic dewaxing reaction zone containing a medium-pore zeolite catalyst and a second hydrotreating reaction zone. By separating the olefinic naphtha prior to the hydrotreating step, hydrogen consumption is reduced and a smaller hydrotreating reactor may be used.

By-products of these catalytic dewaxing processes include highly olefinic gasoline having a research clear octane number in the range of 80 to 95. Motor octane numbers for this olefinic gasoline stream typically range from about 65 to 80. Road octane numbers for finished gasoline product are calculated as the arithmetic mean of the research and motor octane numbers. At the present time, road octane numbers for gasoline sold at retail equal or exceed 87 and generally range between 87 and 93. Highly olefinic gasoline is therefore unsuitable for use as a gasoline blending component. Further, the olefin contents of more than 20 wt. % preclude economic upgrading of this stream via catalytic reforming.

Catalytic reforming is widely used to increase octane in gasoline boiling range feedstocks. Paraffinic feedstocks are more easily upgraded in a catalytic reformer than olefinic feedstocks. Olefinic feedstocks tend to form excessive amounts of coke in the reformer reactors and cause more rapid deactivation of the reforming catalyst. Consequently, reformers are typically equipped with pretreaters which catalytically react naphtha feedstock with hydrogen to saturate olefins and to remove sulfur compounds which poison the reforming catalyst. Hydrogen consumption is related to the concentration of olefinic compounds in pretreater feed and, as a result, olefinic feeds consume significantly more hydrogen during pretreatment than paraffinic feeds, making olefinic feeds more costly to pretreat.

The economic benefit of the catalytic reforming octane boost is offset by liquid product yield loss. This loss becomes more pronounced as reaction severity increases until the economic detriment of yield loss overshadows the economic advantage of the octane boost. For a general discussion of naphtha reforming, see 17 *Kirk Othmer Encyclopedia of Chemical Technology*, 218–220, 3rd edition, 1982.

Thus, the gasoline stream produced in a catalytic dewaxing unit is relatively difficult and expensive to upgrade in a catalytic reforming process. Further, the catalytic reforming process units are typically sized to accommodate the available paraffinic naphtha feed, and lack capacity to process a supplemental olefinic feedstock.

Olefinic gasoline streams may be readily upgraded to high octane gasoline via catalytic aromatization as disclosed in U.S. Pat. No. 3,756,942 to Cattanach and U.S. Pat. No. 3,759,821 to Brennan et al., the disclosures of which are incorporated by reference as if set forth at length herein.

The present process overcomes the disadvantages of previous processes by aromatizing the low-octane highly olefinic gasoline by-product of a low-severity catalytic dewaxing process to form a high-octane gasoline product. Advantageously, the olefinic gasoline by-product is upgraded by charging the gasoline to the catalytic dewaxing reaction zone preferably when the dewaxing catalyst is at least partially deactivated. The present invention enables the refiner to produce a valuable dewaxed distillate or lubricant product as well as a high octane gasoline from a single reactor system.

SUMMARY OF THE INVENTION

The process of the present invention employs a single reaction zone to catalytically dewax a hydrocarbon feedstream and then to upgrade the resulting olefinic by-product stream. The process comprises the steps of charging the feedstock to a reaction zone containing a zeolite catalyst having a Constraint Index between about 1 and 12 under dewaxing conditions to for a reactor effluent stream whereby the zeolite catalyst is at least partially deactivated, fractionating the reactor effluent stream into a dewaxed product, and an olefinic interstage by-product stream, discontinuing flow of the feedstock to the reaction zone, adjusting the raction zone to gasoline conversion temperature, and charging the interstage by-product stream to the reaction zone containing at least partially deactivated zeolite catalyst under conversion conditions evolving an upgraded gasoline boiling range product. The feedstream may include both waxy distillate and waxy lubricant boiling range stocks.

DETAILED DESCRIPTION

Figure 1:
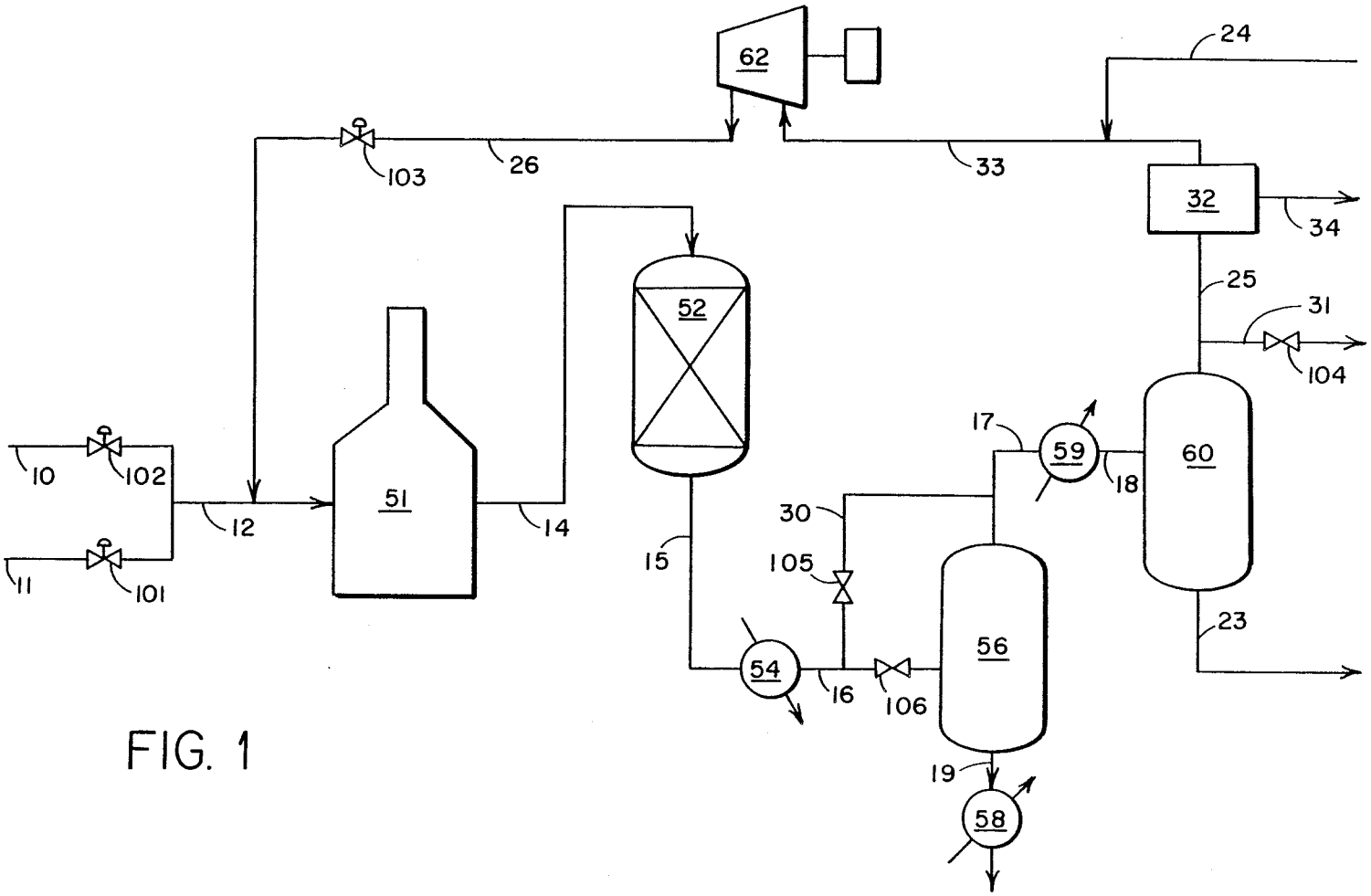
FIG. 1 is a simplified schematic diagram of a first embodiment of the present invention in which the olefinic gasoline by-product of a distillate dewaxing process is upgraded.

During the operation of a catalytic dewaxing process, the catalyst accumulates coke which progressively blocks access to the catalyst pores. This accumulation of coke reduces catalytic activity. To compensate for this loss of catalytic activity, raction temperature is increased.

The feedstocks useful for producing lubricant and distillate products in the present invention are easily cracked. Cracking at least partially converts the highly valuable lubricant and distillate stocks into less valuable light $C_3-$ aliphatic gas and coke which is deposited on the catalyst. Thus, cracking rapidly ages the catalyst and markedly decreases the value of the charge stream. From a practical point of view, therefore, catalytic dewaxing temperature is limited by the cracking temperature of the feedstock. Dewaxing catalyst is considered to be deactivated when the activity level has decreased to the point that reaction temperatures mild enough to avoid excessive cracking are insufficient to dewax the feedstock to the desired pour point.

Surprisingly, it has been found that even though the catalyst activity is too low to effectively produce a dewaxed lubricant product, the same deactivated dewaxing catalyst has been found to have sufficient activity at higher temperatures to upgrade low octane olefinic gasoline. The degree of such upgrade is a function of reaction conditions. Relatively mild conditions tend to favor olefin interconversion and aromatization. Under more severe conditions, paraffins dehydrogenate to form olefins. The newly formed olefins together with those initially present in the feedstream are readily converted, with aromatization predominating over olefin interconversion.

PROCESS OPERATION

Catalytic dewaxing conditions include a temperature between about 475° and 800° F., and a pressure between about 100 and about 3000 psig. The liquid hourly space velocity is generally between about 0.1 and about 10 and the hydrogen to feedstock ratio is generally between about 0 and about 8000 SCF/BBL feed. Broad and preferred ranges of process conditions for dewaxing both distillate and lubricant stocks are summarized in Table 1.

The catalytic dewaxing process of this invention may be conducted by contacting the feed to be dewaxed with a stationary bed of defined crystalline aluminosilicate zeolite catalysts, or with a transport bed, as desired. A simple and therefore preferred configuration is a trickle-bed operation in which the feed is allowed to trickle through a stationary fixed bed, preferrably in the presence of hydrogen. With such configuration, it is of considerable importance in order to obtain the benefits of this invention to initiate the dewaxing reaction with fresh catalyst at a temperature of about 475° to 550° F., depending on the required product quality. This temperature is, of course, raised as the catalyst ages, in order to maintain the desired reaction rate. The run is terminated when the reactor reaches the end-of-run temperature which is typically just below the temperature at which feedstock cracking becomes excessive. Degradation in product quality accompanied by an increase in light $C_4-$ gas production signals excessive feedstock cracking. This rapidly ages the catalyst by blocking the active sites with a relatively heavy layer of coke. Excessive cracking of the feedstock is therefore highly undesirable and must be minimized for economic unit operation. In the present process, feedstock charge is discontinued when the reaction temperature nears a level which would promote excessive cracking. For distillate dewaxing, the maximum feedstock charge temperature is typically about 427° C. (800° F.) and for lubricant dewaxing the maxiumum charge temperature is typically about 357° C. (675° F.).

Dewaxing operation produces by-products comprising light hydrocarbon gas as well as $C_5+$ olefinic gasoline. The light gas stream is flashed to separate and recycle hydrogen to the reaction zone, while the remaining hydrocarbons are routed to a gas plant for further separation. The $C_5+$ olefinic gasoline by-product preferably containing a significant portion of the $C_4$ olefins evolved in the dewaxing process is stored during the dewaxing run for use as reactor feed during a gasoline upgrading run.

When the catalytic dewaxing reaction temperature approaches the end-of-run temperature as described above, the flow of feedstock to the reaction zone is shut off. Hydrogen-rich gas is circulated through the process furnace and the reaction zone to change the temperature of the reaction zone from dewaxing temperature to olefinic gasoline conversion temperature. During this step, the catalyst typically regains a portion of its original catalyst activity. The circulation gas may alternatively comprise an oxygen-containing gas to effect at least a partial oxidative reactivation.

During the time which hydrogen-rich or oxygen-containing gas is circulating through the process furnace and the reaction zone, the dewaxing feedstock is preferably drained from the process equipment. If the dewaxing feedstock cannot be drained in the time allotted for the gas circulation step, the dewaxing feedstock may be separated from the upgraded gasoline product in a downstream product separation facility.

Olefinic gasoline conversion conditions include a temperature of between about 650° and about 1500° F. and a pressure between about 20 and about 300 psig. The weight hourly space velocity is generally between about 0.3 and about 300. Olefinic gasoline conversion conditions are summarized in Table 2.

The choice of process temperature and space velocity within the broad range of gasoline conversion conditions is largely an economic decision. More severe conditions of temperature and space velocity favor aromatization, while less severe conditions favor olefin interconversion. Aromatization affords a greater octane boost (approximately 20 to 40 clear motor octane numbers) accompanied by a more severe loss in liquid product yield. Upgrading reactions favored by less severe conversion conditions, for example, olefin interconversion and partial aromatization, provide less increase in octane (approximately 5 to 20 clear motor octane numbers) but yield a relatively greater volume of liquid product. Preferably, reaction temperature and space velocity are optimized to satisfy the minimum octane number requirement while maximizing the volume of liquid gasoline product.

TABLE 1

| Dewaxing Process Conditions | | |
|---|---|---|
| | Lubricant Dewaxing | Distillate Dewaxing |
| LHSV ($hr^{-1}$) | 0.1-10 | 0.1-10 |
| Reactor Operating Temperature °C. (°F.) | 246°-357° C. (475°-675° F.) | 260°-371° C. (500°-850° F.) |
| Operating Pressure kPa (psig) | 790-20,790 kPa (100-3000 psig) | 790-20,790 kPa (100-3000 psig) |
| Hydrogen Dosage SCF/BBL feed | 0-8000 | 0-8000 |

TABLE 2

| Olefinic Gasoline Upgrading Reaction Process Conditions | | |
|---|---|---|
| | Olefin Interconversion/ Partial Aromatization | Aromatization |
| WHSV | Broad range: 0.3-20 $hr^{-1}$ Preferred range: 0.5-5.0 $hr^{-1}$ | Broad range: 0.3-300 $hr^{-1}$ Preferred range: 1-10 $hr^{-1}$ |
| Operating Pressure | Broad: 240-4230 kPa (20-600 psig) Preferred: 790-1480 kPa (100-200 psig) | Broad: 170-2170 kPa (10-300 psig) Preferred: 310-790 kpa (30-100 psig) |
| Reactor Outlet Temperature | Broad: 340-540° C. (650-1000° F.) Preferred: 370-490° C. (700-900° F.) | Broad: 540-820° C. (1000-1500° F.) Preferred: 560-620° C. (1050-1150° F.) |

CATALYSTS

The medium-pore zeolite catalysts useful in the present invention have an effective pore size of generally from about 5 to about 8 Angstroms, such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although, in some instances, excessive puckering of the rings or pore blockage may render these zeolite ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons, and therefore, it is not the present intention to entirely judge the usefulness of the particular zeolite solely from theoretical structural considerations.

A convenient measure of the extent to which a zeolite provides control to molecules of varying sizes to its internal structure is the Constraint Index of the zeolite. The method by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as if set forth at length herein.

The medium-pore catalysts particularly useful in the present invention include zeolite catalysts having the structure of ZSM-5, ZSM-11, ZSM-12, ZSM-22, ZSM-23, ZSM-35, ZSM-48 and other similar materials. U.S. Pat. No. 3,702,886 describing and claiming ZSM-5 is incorporated herein by reference. Also, U.S. Pat. RE. No. 29,948 describing and claiming a crystalline material with an X-ray diffraction pattern of ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-48 is more particularly described in U.S. Pat. No. 4,375,573, the entire contents of which are incorporated herein by reference.

The zeolites suitable for use in the present invention can be modified in activity by dilution with a matrix component of significant or little catalytic activity.

Catalysts including zeolites such as ZSM-5 combined with a Group VIII metal described in U.S. Pat. No. 3,856,872, incorporated by reference as if set forth at length herein, are also useful in the present invention of these catalysts. Nickel-containing ZSM-5 is particularly preferred for the dewaxing process of the present invention.

DESCRIPTION OF THE FIRST EMBODIMENT

In a first embodiment of the present invention, a distillate feedstock is dewaxed and the by-product olefinic gasoline is upgraded to high octane gasoline blending stock.

Referring now to FIG. 1, a waxy distillate boiling-range feedstock is charged to the process unit via line 10. Valve 102 is open during dewaxing operation and valve 101 is closed, allowing the waxy feedstock to flow into furnace charge line 12. Hydrogen-rich circulation gas flows through line 26 which is equipped with control valve 103 and enters furnace charge line 12. The combined liquid and gas feed is charged to furnace 51 where the mixture is heated to dewaxing temperature. The hot feed mixture flows out of furnace 51 via line 14 and is charged to the inlet of reactor 52 which is preferably a fixed-bed reactor.

Dewaxed product together with olefinic gasoline, light $C_4-$ gas and a small amount of kerosene flows out of reactor 52 through line 15 to reactor effluent cooler 54. Cooled reactor effluent flows from reactor effluent cooler 54 through line 16 to high temperature flash drum 56. Dewaxed liquid product leaves high temperature flash drum 56 through line 19 and optionally flows to product cooler 58 before it is routed to storage (not shown). High temperature flash drum overhead vapor flows through line 17 to overhead cooler 59. The cooled overhead stream is then fed to low temperature flash drum 60 via line 18. A hydrogen-rich circulation gas stream comprising hydrogen with minor amounts of $C_2$− light gas flows overhead from low temperature flash drum via line 25.

The circulation gas stream from line 25 is charged to purification unit 32 which removes sulfur- and nitrogen-containing compounds from the circulation gas stream. $C_1$–$C_4$ gas is removed from purification unit 32 through line 34 for further processing or to be burned as fuel gas. The purified hydrogen-rich circulation gas stream then flows from purification unit 32 through line 33, where its hydrogen content may optionally be supplemented with hydrogen-rich makeup gas. The combined gas stream then flows to compressor 62, which is typically a centrifugal compressor.

As the catalyst in reactor 52 becomes deactivated, the reaction temperature is increased. When the reactor outlet temperature approaches the end-of-run temperature, valve 102 is closed, stopping the flow of waxy hydrocarbon feedstock to the unit. Hydrogen-rich gas is then circulated through a recycle loop which includes furnace 51, reactor 52, high temperature flash drum 56, low temperature flash drum 60 and compressor 62. Liquid remaining in the process equipment is withdrawn from the unit at a point of relatively low elevation, for example, the high temperature flash drum bottoms line 19. This heavy (400+° F. boiling point) stream may be fractionated in an existing product fractionation section.

When reactor 52 reaches olefinic gasoline conversion temperature, valve 101 is opened and olefinic gasoline flows through line 11, through valve 101 and into furnace charge line 12. Hydrogen may be optionally added via lines 24, 25 and 26 at a rate sufficient to maintain the reaction heat balance or the necessary minimum velocity. The nahtha upgrading reaction is slightly exothermic at lower temperatures within the ranges disclosed in Table 2. At higher temperatures within the ranges of Table 2, paraffin dehydrogenation tends to shift the reaction zone toward net endothermic conditions. Thus, the heat balance in the reaction zone depends both on temperature as well as feed composition.

The olefinic gasoline optionally including a small amount of kerosene and optionally mixed with added hydrogen, is charged to furnace 51. Hot effluent is withdrawn via line 14 and charged to reactor 52. Upgraded gasoline is withdrawn from reactor 52 via line 15, cooled in reactor effluent cooler 54. The cooled effluent is withdrawn from reactor effluent cooler 54 via line 16. Valve 106 positioned in line 16 is closed and flow is diverted through line 30 and open valve 105 to line 17 which feeds into overhead cooler 59. The cooled reactor effluent stream is then charged through line 18 to low temperature flash drum 60 where $C_4$− light gas flows overhead through line 25. Valve 107 positioned in line 25 is closed and valve 104 in line 31 is open, directing the light gas flow through line 31 to a separation section (not shown). Aromatized gasoline product flows from low temperature flash drum 60 to a product recovery section (not shown) through line 23.

DESCRIPTION OF THE SECOND EMBODIMENT

In a second embodiment of the present invention, a lubricant feedstock is dewaxed and hydrotreated and the olefinic interstage by-product is upgraded. The interstage by-product includes both gasoline and kerosene boiling range fractions. At least a portion of the kerosene may be upgraded together with the gasoline as described below.

Figure 2:
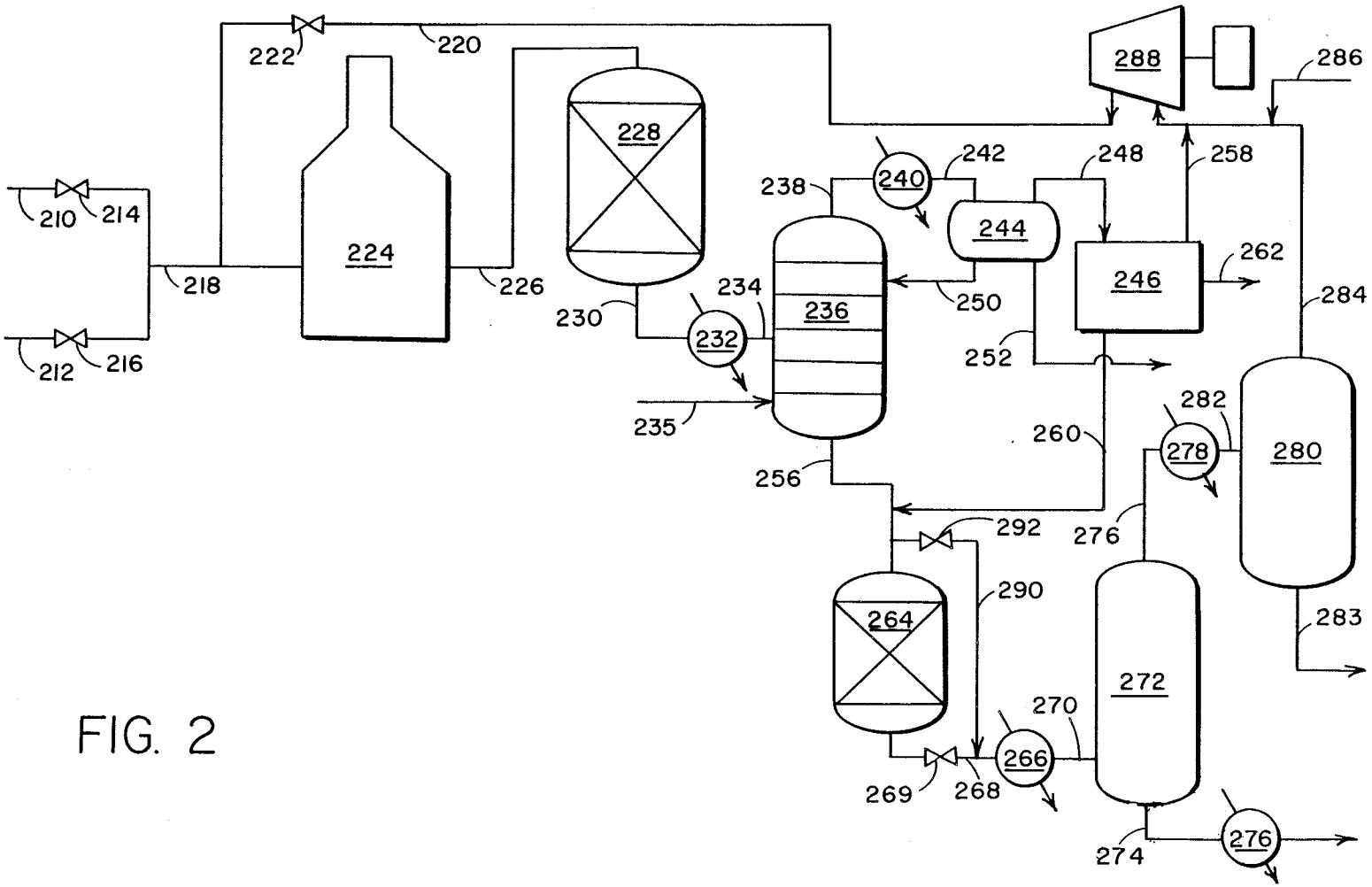
FIG. 2 is a simplified schematic diagram of a second embodiment of the present invention in which an olefinic gasoline by-product is separated from the interstage product of a lubricant hydrodewaxing process and upgraded.

Referring now to FIG. 2, a waxy lubricant feedstock boiling above about 343° C. (650° F.) is charged to the process unit via line 210. Valve 214 is open during dewaxing operation and valve 216 is closed, allowing the waxy lubricant feedstock to flow into furnace charge line 218. Hydrogen-rich circulation gas flows through line 220 which is equipped with control valve 222 and enters furnace charge line 218. The combined liquid and gas feed is charged to furnace 224 where the mixture is heated to dewaxing temperature. The hot feed mixture flows out of furnace 224 via line 226 and is charged to the inlet of reactor 228, which is preferably a fixed-bed reactor.

Dewaxing reactor effluent comprising dewaxed lubricant stock, interstage by-product including gasoline and kerosene fractions, light $C_4$− gas and hydrogen flow out of reactor 228 through line 230 to reactor effluent cooler 232. Cooled reactor effluent flows from reactor effluent cooler 232 through line 234 to fractionator 236 which separates interstage by-product and lighter products from the dewaxed lubricant stock. Steam may be charged to fractionator 236 via steam inlet line 235 if it is desired to effect a steam distillation to enhance product separation. Interstage by-product and lighter products are withdrawn from the top of fractionator 236 through line 238, partially condensed in overhead condenser 240 and fed to condensate drum 244 via line 242. A condenstate drum overhead vapor stream including hydrogen and light $C_4$− gas flows from condensate drum 244 to purification unit 246 via line 248. The flow of interstage by-product from condensate drum 244 is split between fractionator reflux line 250 and interstage by-product line 252. Fractionator reflux line 250 charges a portion of the condensed olefinic gasoline to an upper tray of fractionator 236 while interstage by-product line 252 routes the olefinic gasoline to storage (not shown). Several factors determine the most preferable distillation cut in fractionator 236. If seasonal weather conditions and storage facilities permit, operation of the fractionator should be adjusted to increase $C_3$–$C_4$ aliphatics content in the interstage by-product. This material will react readily in the subsequent by-product upgrading run to yield valuable gasoline product. However, if tankage available for interstage by-product storage is unsuitable for relatively high vapor pressure service, the fractionator should be operated to produce a bottoms product which is compatible with the vapor pressure limitations of the available tankage.

Purification unit 246 removes sulfur- and nitrogen-containing compounds from the condensate drum overhead vapor stream and recycles hydrogen-rich gas to low temperature flash drum overhead line 284 and hydrotreater charge line 256 through lines 258 and 260, respectively. Optionally, $C_1$–$C_4$ gas is removed from purification unit 246 through line 262 for further processing or to be burned as fuel gas.

Dewaxed lubricant stock is withdrawn from fractionator 236 by hydrotreater charge line 256, mixed with hydrogen-rich gas from line 260 as described above, and charged to hydrotreater 264. Details of hydrotreater operation are set forth in the references cited above. Hydrotreated product flows from hydrotreater 264 to hydrotreater effluent cooler 266 through line 268 which is equipped with valve 269. Cooled hydrotreater effluent then flows through line 270 to high temperature flash drum 272 through line 274 and optionally flows to product cooler 276 before it is routed to storage. High temperature flash drum overhead vapor flows through line 276 to overhead cooler 278. The cooled overhead stream is then fed to low temperature flash drum 280 via line 282. A circulation gas stream comprising hydrogen with minor amounts of $C_2-$ light gas flows overhead from low temperature flash drum via line 284, while a minor amount of interstage by-product flows to storage from the bottom of low temperature flash drum 280 via line 283. Hydrogen-rich make-up gas is charged to line 284 via line 286 to increase the hydrogen content of the circulation gas stream.

The circulation gas stream from line 284 is joined by the purified hydrogen-rich gas stream from line 258 and is charged to compressor 288 and flows through line 220 to furnace charge line 282. Compressor 288 is typically a centrifugal compressor.

As the catalyst in reactor 228 becomes deactivated, the reaction temperature is increased. When the reaction temperature approaches the feedstock cracking temperature, valve 214 is closed, stopping the flow of waxy lubricant feedstock to the unit and initiating the catalyst reactivation step. Circulation gas then flows through a recycle loop which includes furnace 224, reactor 228, fractionator 236, hydrotreater 264, high temperature flash drum 272, low temperature flash drum 280 and compressor 288.

As mentioned above, during this step, the circulation gas may optionally comprise an oxygen-containing gas. Also, during this step, the dewaxing feedstock remaining in the process equipment is preferably drained.

Hydrocarbon liquid is preferably drained from each vessel at the initiation of the reactivation step. The process unit is configured for catalyst reactivation by setting valves (not shown) associated with the schematically illustrated process piping to cycle hydrogen-rich or oxygen-containing circulation gas through the unit. Thus, the circulation gas flows through furnace 224, line 226, reactor 228, line 230, cooler 232, line 234, fractionator 236, line 256, hydrotreater 264, line 268, cooler 266, line 270, high temperature flash drum 272, line 276, cooler 278, line 282, low temperature flash drum 280, line 284, compressor 288 and through line 220 back to line 218 and furnace 224. Liquid is drawn off at a low elevation in the process unit, typically at the bottom of the high temperature separator. Make-up hydrogen may be added to the recycle loop via line 286. When reactor 228 reaches olefinic gasoline conversion temperature and when the catalyst is sufficiently reactivated to promote upgrading of olefinic interstage by-product, valve 216 is opened and the interstage by-product from storage flows through line 212, through valve 216 and into furnace charge line 218. Hydrogen may be optionally added via line 286, at a rate sufficient to maintain the reaction heat balance or the necessary minimum space velocity.

The interstage by-product, optionally mixed with added hydrogen, is charged to furnace 224. Hot effluent is withdrawn via line 226 and charged to reactor 228. Upgraded product is withdrawn from reactor 228 via line 230, cooled in reactor effluent cooler 232 and charged to fractionator 236. An upgraded gasoline fraction containing branched aliphatics as well as aromatics is withdrawn from fractionator 236 via line 256 and is bypassed around hydrotreater 264 through line 290 which is equipped with valve 292. The upgraded gasoline fraction enters line 268 downstream of closed valve 269 and is at least partially condensed in cooler 266 before it enters high temperature flash drum 272 through line 270. The $C_4-$ overhead stream from fractionator 236 flows through line 238 to overhead condenser 240 and is separated and partially refluxed as described above. Hydrogen-rich circulation gas is returned to the circulation loop via line 258, while effluent from line 262, rich in $C_1$–$C_2$ light gas, is typically burned as fuel gas.

Upgraded $C_5+$ gasoline product is withdrawn from the bottom of high temperature flash drum 272 through line 274 and may optionally be adjusted in product cooler 276 before the gasoline product is sent to a stabilizer (not shown).

Changes and modifications in the specifically described embodiments can be carried out without departing from the scope of the invention which is intended to be limited only by the scope of the appended claims.

We claim:

1. A process for catalytically dewaxing a waxy hydrocarbon feedstock and for producing upgraded gasoline comprising the steps of:

(a) charging said waxy hydrocarbon feedstock to a reaction zone containing a zeolite catalyst having a Constraint Index between about 1 and 12 under dewaxing conditions to form a reactor effluent stream whereby said zeolite catalyst is at least partially deactivated;

(b) fractionating said reactor effluent stream into a dewaxed product and an interstage by-product stream;

(c) discontinuing said waxy hydrocarbon feedstock charging of step (a) when said zeolite catalyst has been deactivated to the point that the reaction temperature required for dewaxing said waxy hydrocarbon feedstock to the desired pour point causes excessive cracking of said waxy hydrocarbon feedstock;

(d) adjusting said reaction zone to gasoline conversion temperature;

(e) charging said interstage by-product stream of step (b) to said reaction zone containing said zeolite catalyst of step (c) under gasoline conversion conditions evolving an upgraded gasoline product.

2. The process of claim 1 wherein said temperature adjusting step (d) comprises flowing a hydrogen-containing gas through said reaction zone whereby said catalyst is at least partially reactivated.

3. The process of claim 1 wherein said temperature adjusting step (d) comprises flowing an oxygen-containing gas through said reaction zone whereby said catalyst is at least partially reactivated.

4. The process of claim 1 further comprising charging a $C_4-$ hydrocarbons together with said interstage by-product stream to said reaction zone under gasoline conversion conditions.

5. The process of claim 1 wherein said dewaxed product comprises a distillate boiling range product.

6. The process of claim 1 wherein said dewaxing conditions comprise hydrogen dosage rates between 0 and about 8000 SCF/BBL of feedstock, pressures between 790 and 20,790 kPa (100 and 3000 psig) and temperatures between about 246° and 357° C. (475° and 675° F.).

7. The process of claim 1 wherein said zeolite has the structure of at least one selected from the group consisting of ZSM-5, ZSM-11, ZSM-22, ZSM-23, ZSM-35 and ZSM-48.

8. The process of claim 7 wherein said zeolite has the structure of ZSM-5.

9. The process of claim 8 wherein said zeolite contains nickel.

10. The process of claim 1 wherein said dewaxing conversion conditions include temperatures between 260° and 454° C. (500° and 850° F.) and pressures between 790 and 20,790 kPa (100 and 3000 psig).

11. The process of claim 1 wherein said gasoline conversion conditions comprise temperatures between 340° and 540° C. (650° and 1000° F.), pressures between 240 and 2170 kPa (20 and 600 psig) and WHSV between 0.3 and 20 $hr^{-1}$.

12. The process of claim 1 wherein said gasoline conversion conditions comprise temperatures between 370° and 490° C. (700° and 900° F.), pressures between 790 and 1480 kPa (100 and 200 psig) and WHSV between 0.5 and 5.0 $hr^{-1}$.

13. The process of claim 1 wherein said gasoline conversion conditions comprise temperatures between 540° and 820° C. (1000° and 1500° F.), pressures between 170 and 2170 kPa (10 and 600 psig) and WHSV between 0.3 and 300 $hr^{-1}$.

14. The process of claim 1 wherein said gasoline conversion conditions comprise temperatures between 560° and 620° C. (1050° and 1150° F.), pressures between 310 and 790 kPa (30 and 100 psig) and WHSV between 1 and 10 $hr^{-1}$.

15. The process of claim 1 wherein said dewaxed product comprises a lubricant boiling range product.

16. The process of claim 1 wherein said dewaxing conditions comprise hydrogen dosage rates of between about 0 and about 8000 SCF/BBL of feedstock, pressures between 790 and 20,790 kPa (100 and 3000 psig) and temperatures between about 246° and about 357° C. (475° and 675° F.).

17. The process of claim 15 wherein said zeolite has the structure of at least one selected from the group consisting of ZSM-5, ZSM-11, ZSM-22, ZSM-23, ZSM-35 and ZSM-48.

18. The process of claim 17 wherein said zeolite has the structure of ZSM-5.

19. The process of claim 18 wherein said zeolite contains nickel.

20. The process of claim 15 wherein said dewaxing conversion conditions include temperatures between 246° and 357° C. (475° and 675° F.) and pressures between 790 and 20,790 kPa (100 and 3000 psig).

21. The process of claim 15 wherein said gasoline conversion conditions comprise temperatures between 340° and 540° C. (650° and 1000° F.), pressures between 240 and 2170 kPa (20 and 600 psig) and WHSV between 0.3 and 20 $hr^{-1}$.

22. The process of claim 15 wherein said gasoline conversion conditions comprise temperatures between 370° and 490° C. (700° and 900° F.), pressures between 790 and 1480 kPa (100 and 200 psig) and WHSV between 0.5 and 5.0 $hr^{-1}$.

23. The process of claim 15 wherein said gasoline conversion conditions comprise temperatures between 540° and 820° C. (1000° and 1500° F.), pressures between 170 and 2170 kPa (10 and 600 psig) and WHSV between 0.3 and 300 $hr^{-1}$.

24. The process of claim 15 wherein said gasoline conversion conditions comprise temperatures between 560° and 620° C. (1050° and 1150° F.), pressures between 310 and 790 kPa (30 and 100 psig) and WHSV between 1 and 10 $hr^{-1}$.

* * * * *